US009370815B2

(12) United States Patent
Jin et al.

(10) Patent No.: US 9,370,815 B2
(45) Date of Patent: Jun. 21, 2016

(54) HYBRID HEAT EXCHANGER

(71) Applicant: Advanced Distributor Products LLC, Grenada, MS (US)

(72) Inventors: Dae-Hyun Jin, Stone Mountain, GA (US); Christopher Beck, Grenada, MS (US)

(73) Assignee: Advanced Distributor Products LLC, Grenada, MS (US)

( * ) Notice: Subject to any disclaimer, the term of this patent is extended or adjusted under 35 U.S.C. 154(b) by 0 days.

(21) Appl. No.: 14/619,694

(22) Filed: Feb. 11, 2015

(65) Prior Publication Data

US 2015/0151351 A1 Jun. 4, 2015

Related U.S. Application Data

(62) Division of application No. 13/307,273, filed on Nov. 30, 2011, now Pat. No. 8,978,409.

(60) Provisional application No. 61/501,927, filed on Jun. 28, 2011.

(51) Int. Cl.

| | |
|---|---|
| ***F28F 9/007*** | (2006.01) |
| ***B21D 53/08*** | (2006.01) |
| ***F25B 39/00*** | (2006.01) |
| ***F28D 1/047*** | (2006.01) |
| ***F28F 1/02*** | (2006.01) |
| ***B21D 39/06*** | (2006.01) |
| ***F28F 1/32*** | (2006.01) |
| ***F28F 9/013*** | (2006.01) |

(52) U.S. Cl.

CPC ..... *B21D 53/08* (2013.01); *B21D 39/06* (2013.01); *F25B 39/00* (2013.01); *F28D 1/0475* (2013.01); *F28F 1/025* (2013.01); *F28F 1/325* (2013.01); *F28F 9/0131* (2013.01); *Y10T 29/4935* (2015.01); *Y10T 29/4938* (2015.01)

(58) Field of Classification Search

CPC ..... B21D 53/08; B21D 39/06; F28F 9/0131; F28F 1/325; F28F 1/025; F28F 1/0475; F25B 39/00; Y10T 29/4938; Y10T 29/4935

See application file for complete search history.

(56) References Cited

U.S. PATENT DOCUMENTS

| | | | | |
|---|---|---|---|---|
| 3,780,799 | A | 12/1973 | Pasternak | |
| 3,894,580 | A | 7/1975 | Chartet | |
| 5,004,045 | A | 4/1991 | Le Gauyer | |
| 5,158,134 | A * | 10/1992 | Mongia | F28D 1/0477 165/149 |
| 5,228,511 | A * | 7/1993 | Boquel | F28F 9/001 165/149 |
| 5,562,153 | A | 10/1996 | Sasaki | |
| 6,378,204 | B1 | 4/2002 | Kim et al. | |
| 6,550,273 | B2 | 4/2003 | Fujitaka et al. | |
| 6,823,932 | B2 | 11/2004 | Birkholz | |

(Continued)

*Primary Examiner* — Jacob Cigna
*Assistant Examiner* — Lee A Holly
(74) *Attorney, Agent, or Firm* — Bell Nunnally & Martin LLP; Craig J. Cox

(57) ABSTRACT

This disclosure presents a heat exchanger that comprises a header frame having end plates, a plurality of rows of finned hairpins, each extending through a cooling fin and each having ends extending through the end plates, and at least one finless hairpin having ends extending through the end plates. Additionally, a support sheet is coupled to the header frame and at least on finless hairpin extends through the support sheet and is supported thereby. A method of manufacturing the heat exchanger is also presented as well as a heat ventilation air conditioning system in which the heat exchanger may be employed.

8 Claims, 5 Drawing Sheets

(56) References Cited

U.S. PATENT DOCUMENTS

| | | | |
|---|---|---|---|
| 6,827,129 | B2 | 12/2004 | Ozawa et al. |
| 6,857,288 | B2 | 2/2005 | Ha et al. |
| 6,928,833 | B2 | 8/2005 | Watanabe et al. |
| 7,156,163 | B2 | 1/2007 | Heng-I et al. |
| 7,296,620 | B2 | 11/2007 | Bugler, III et al. |
| 7,779,898 | B2 | 8/2010 | Morrison et al. |
| 2007/0240862 | A1 | 10/2007 | Baudat et al. |
| 2010/0011804 | A1 | 1/2010 | Taras et al. |
| 2010/0043452 | A1 | 2/2010 | Baudat et al. |
| 2013/0000347 | A1 | 1/2013 | Jin et al. |

* cited by examiner

HYBRID HEAT EXCHANGER

RELATED APPLICATION

The present application is a Divisional of U.S. application Ser. No. 13/307,273 filed on Nov. 30, 2011, entitled "HYBRID HEAT EXCHANGER," currently pending; which application is based on U.S. Provisional Application, Ser. No. 61/501,927, filed Jun. 28, 2011, both of which are incorporated herein by reference.

TECHNICAL FIELD

This application is directed to a hybrid heat exchanger, and more specifically to a hybrid heat exchanger that may be used in a heating and ventilation air conditioning (HVAC) system.

BACKGROUND

For decades, HVAC heat exchangers have been comprised primarily of copper. However, in recent years due to the increase in the cost of copper, HVAC manufacturers have begun seeking more cost effective solutions for the materials from which they manufacture heat exchangers. One such alternative material is aluminum, but since aluminum is not as strong a material as copper, manufacturers have had to compensate for this material difference by increasing the thickness of the aluminum tubing, which in turn, decreases internal volume.

SUMMARY

In one embodiment there is provided a heat exchanger that comprises a header frame having end plates, a plurality of rows of finned hairpins, each extending through a cooling fin and each having ends extending through the end plates, and at least one finless hairpin having ends extending through the end plates.

In another embodiment, there is provided a HVAC system comprising, a compressor, an evaporator fluidly connected to the compressor and having a first fan associated therewith, and a condenser fluidly connected to the compressor and having a second fan associated therewith. At least one of the evaporator or condenser comprises; a header frame having end plates, a plurality of rows of finned hairpins, each extending through a cooling fin and each having ends extending through the end plates, and a plurality of finless hairpins having ends extending through the end plates.

Another embodiment provides a method of manufacturing the heat exchanger. This embodiment comprises providing a header frame having end plates, a plurality of hairpins and cooling fins have openings located therethrough. In the method a portion of the plurality of hairpins are placed through each of the openings. Each of the portion are expanded such that each hairpin expands against the circumference of the openings to form a plurality of rows of finned hairpins. Opposing ends of the finned hairpins are placed through a portion of the openings in opposing end plates of the header frame, and opposing ends of finless hairpins are placed through a remaining portion of the openings in opposing end plates of the header frame. Also, a support sheet is coupled to the header frame, such that the at least one finless hairpin extends through the support sheet and is supported thereby.

BRIEF DESCRIPTION OF DRAWINGS

Reference is now made to the following descriptions taken in conjunction with the accompanying drawings, in which.

DETAILED DESCRIPTION

For an aluminum slab, composed of aluminum fins and aluminum hairpins (i.e. refrigerant tubes), the internal volume is smaller than that for a copper slab having the same number of hairpins with the same outside diameter as copper hairpins because of thicker walls that are required to achieve the requisite tensile strength need for a heat exchanger. This is due to the fact that aluminum has a lesser tensile strength than copper. As such, the wall must be made thicker in order to withstand the refrigerant pressure associated with a refrigeration cycle.

In order to increase the internal volume using conventional processes, especially for heat pump applications, manufacturers have typically added more hairpins with cooling fins by either increasing slab height or adding more row or rows. However, increasing slab height with the same number of rows causes lower frontal velocity for the same air flow rate resulting in lower efficiency. Additionally, adding more row or rows for the same height slab causes higher air side pressure drop, which is an undesirable effect.

It has been presently found that an effective way of increasing the internal volume without a loss of cooling efficiency is to add one or more additional rows of finless hairpins, that is, hairpins that do not have any cooling fins attached to them. If hairpins are added by increasing slab height with the same number of rows resulting in a taller evaporator, this is a negative effect on the end user resulting in an evaporator that will not fit into the existing cooling chamber of the end user. The pressure drop associated with the extra row of finned hairpins is a negative outcome for the end user resulting in not achieving the correct airflow required for the system. Adding a finless row or rows will achieve the required internal volume, while maintain the desired height and airside pressure drop of the heat exchanger, without adding the negative results of increased height and additional finned row or rows. This technique can be used in both aluminum and copper heat exchangers. However, a "finless" hairpin is very counter intuitive to conventional practices that teach that cooling fins are highly desirable on all of the refrigerant tubes that make up the core of the slab of the heat exchanger to effect the desired amount of heat transfer. Moreover, the concepts as provided herein can be added on to either existing copper based or aluminum based heat exchangers.

Figure 1:
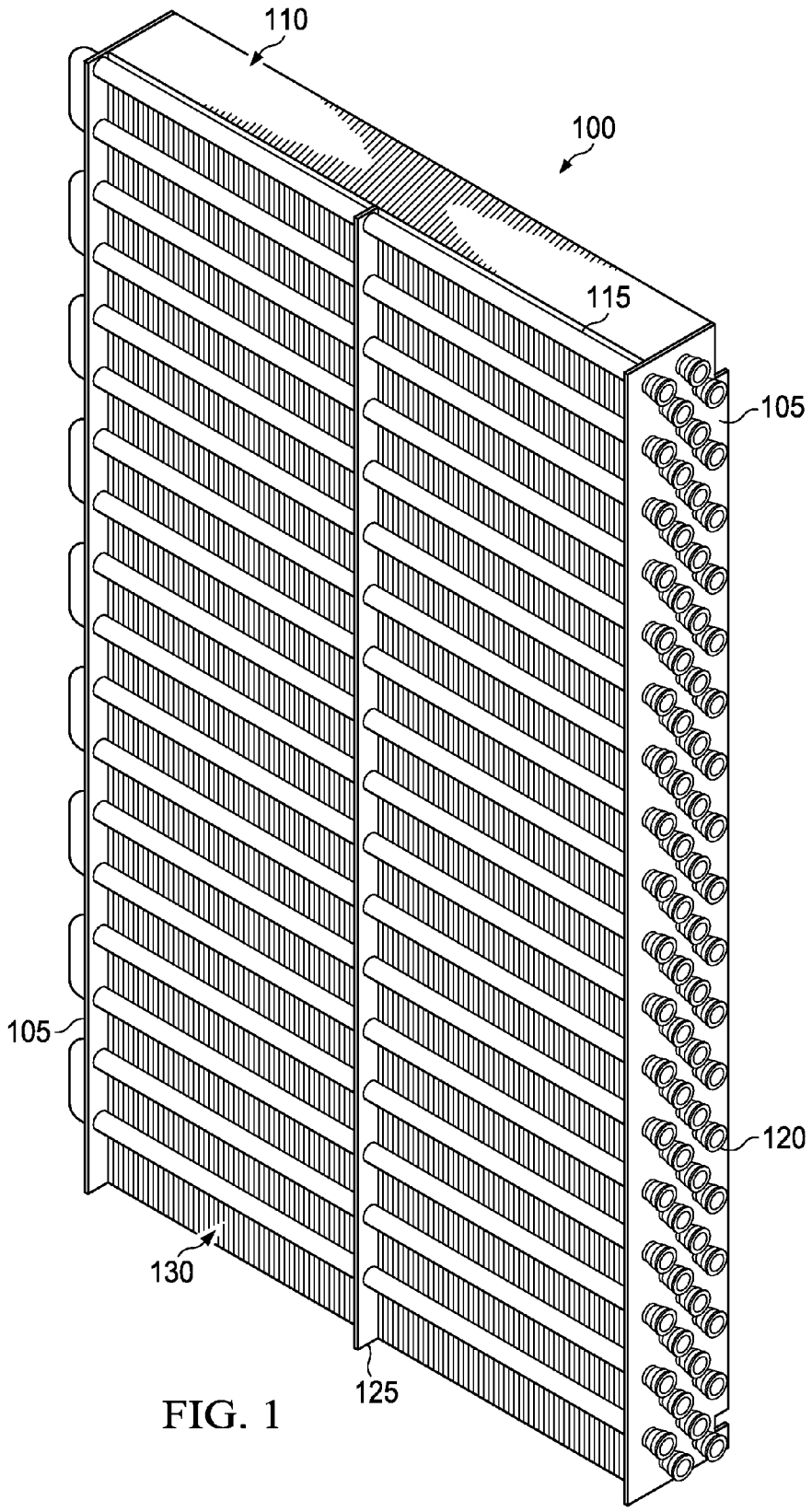
FIG. 1 illustrates one embodiment of a heat exchanger as provided by this disclosure.

FIG. 1 illustrates one embodiment of a heat exchanger 100, as presented herein. This particular embodiment comprises header plates 105 and body frame 110 and one or more finless hairpins 115 and coupling ends 120 that extend through one of the headers 105 for the finless hairpins 115 and finned hairpins, not shown in this view. As discussed below, the number of additional rows of finless hairpins 115 can vary, depending on the design requirements. However, the number of rows of finned hairpins will be significantly greater than the number of finless hairpins 115 to achieve the desired amount of heat transfer within the heat exchanger 100. This embodiment may also include a support sheet 125 that is present for purposes of providing structural support for the finless hairpins 115 and in certain embodiments may also serve as support for the finned hairpins.

It should be noted that the support sheet 125 is distinguished from cooling fins 130, illustrated by the horizontal lines, in that the primary purpose of the support sheet 125 is to provide support and not intended to provide a heat exchange function, even though heat transfer may take place between the hairpins 115 and the support sheet 125. The support sheet 125 is in contrast to a cooling fin 130 whose purpose is to transfer heat from the hairpin to which it is attached. Moreover, there is a distinguishable difference in dimensions between the support sheet 125 and a cooling fin 130. For example, in one embodiment, the support sheet 125 may have a surface to volume ratio of at most about 40/cm, whereas a cooling fin 130 will typically have a surface to volume ratio of at least about 200/cm. In one such embodiment, the thickness of a cooling fin 130 will be about 0.11 mm, while the thickness of the support sheet 125 may have a thickness that is about 0.5 mm to about 1.27 mm, or greater in other embodiments.

Also seen in this view are the coupling ends 120 to which return bends, not shown, can be attached to each pair of hairpins to close off the pair, such that they can serve as a sealed refrigeration loop within the heat exchanger 100.

The addition of one or more rows of finless hairpins 115 provides an increased internal volume of the heat exchanger 100 without increasing its overall size. This is particularly useful in heat exchangers that are comprised of aluminum.

Figure 2:
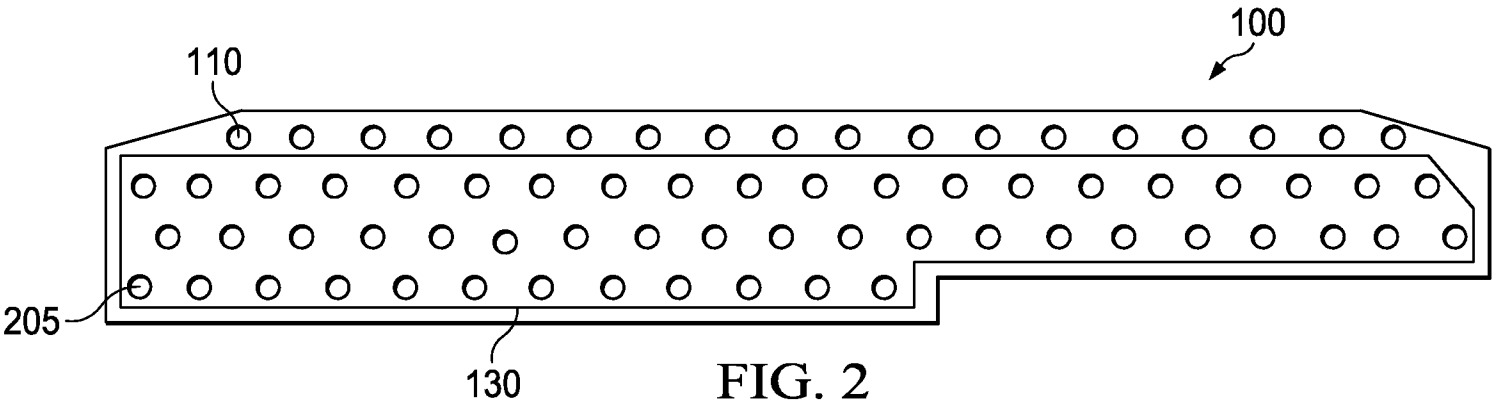
FIG. 2 illustrates a sectional view of one embodiment of the heat exchanger as provided herein.

FIG. 2 illustrates a sectional view of the heat exchanger 100 of FIG. 1 taken along A-A, wherein both the finless hairpins 110 of FIG. 1, one of the cooling fins 130, and finned hairpins 205 are shown. The cooling fin 130 may be of any conventional type. For example, they may be circular fins or may be rectangular strips or sheets and may or may not be soldered to each of the hairpins 205. In the illustrated embodiment, the cooling fin 130 is fabricated by punching holes through stacked metal sheets and then inserting the hairpins through the appropriate punched holes. The hairpins are then mechanically expanded until they securely engage the circumferences of each of the punched holes.

Figure 3:
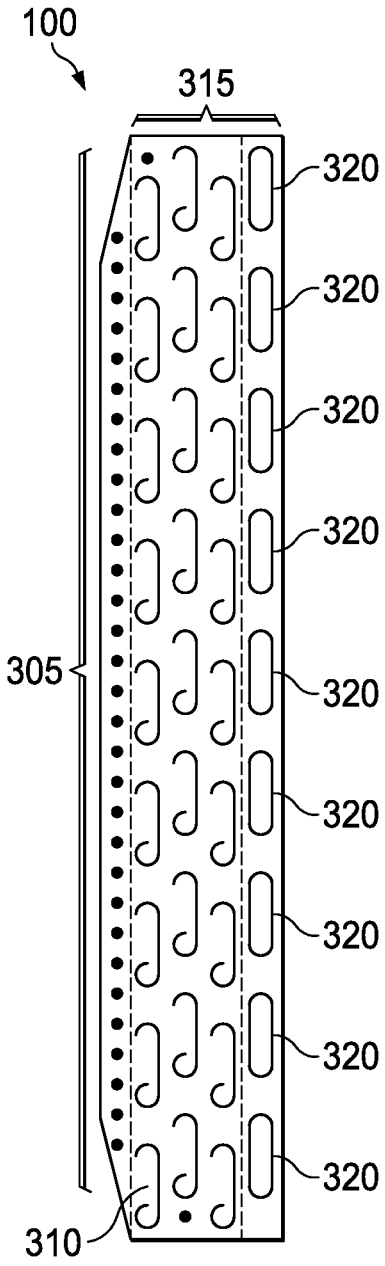
FIG. 3 illustrates a side view of one embodiment of the heat exchanger.

FIG. 3 illustrates an end view of the heat exchanger 100 of FIG. 1. In this configuration, the heat exchanger has 9 rows 305 of hairpins 310 with 4 hairpins 315 in each row, wherein in at least one hairpin 310 will be finless. However in another embodiment, each of the 9 rows 305 will have a finless hairpin 315, while the remaining hairpins 310 in each row 305 will be of a conventional configuration having cooling fins on them. The number of rows 305 and finned hairpins 310 and finless hairpins 320 may vary depending on design requirements.

Figure 4C:
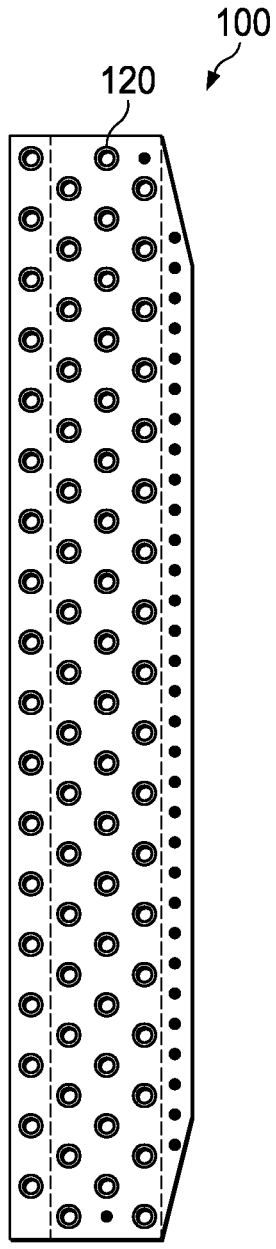
FIGS. 4A-4C illustrate the heat exchanger of FIG. 1 with an enlarged view of one configuration of a coupling end of a hair pin and an end view thereof.
Figure 4A:
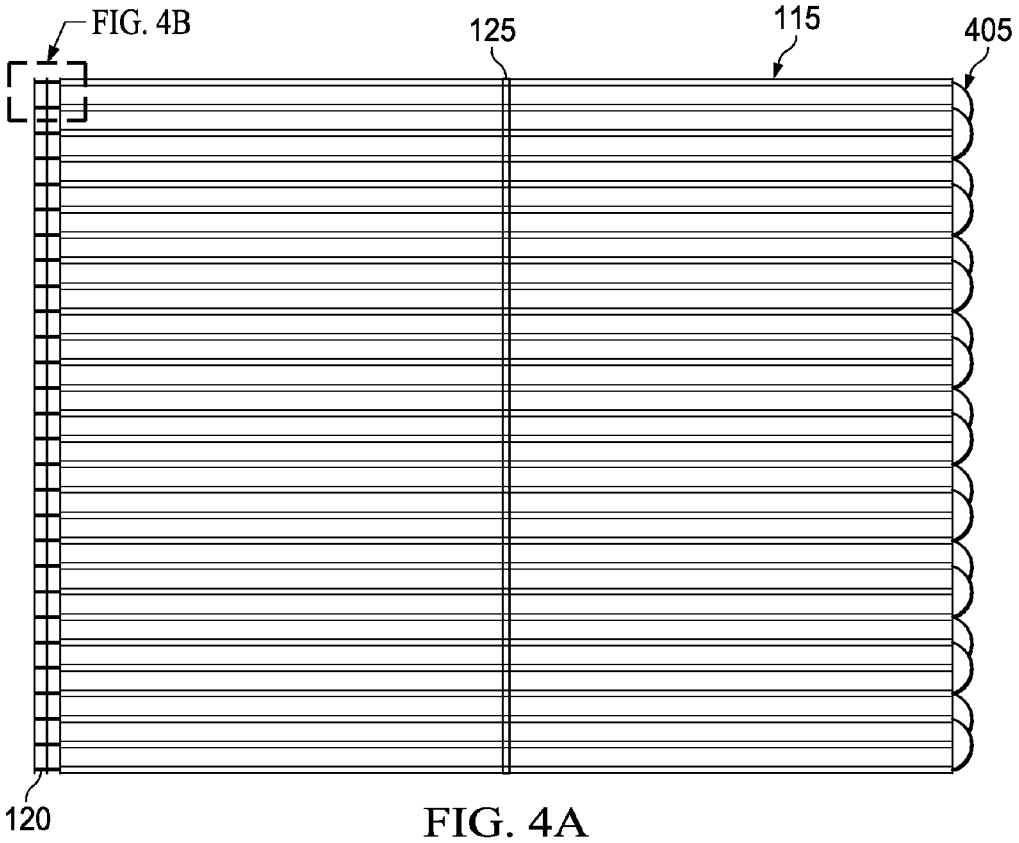
Figure 4B:
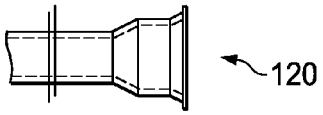

FIGS. 4A-4C show examples of the heat exchanger 100 from a front view (FIG. 4A) and a side view (FIG. 4B) illustrating the coupling ends 120 of the hairpins, and an enlarged view (FIG. 4C) of one of the coupling ends to which return bends 405 may be coupled. For clarity, the finned hairpins are not shown, but the bent parts 405 of the various hairpins together are shown. It should be understood that the number of hairpins, both finned and finless, in any given heat exchanger 100, may vary, depending on design requirements. It should be noted that certain embodiments of the heat exchanger 100 meet size requirements as mandated by governmental regulations, while still achieving the same efficiency.

Figure 5A:
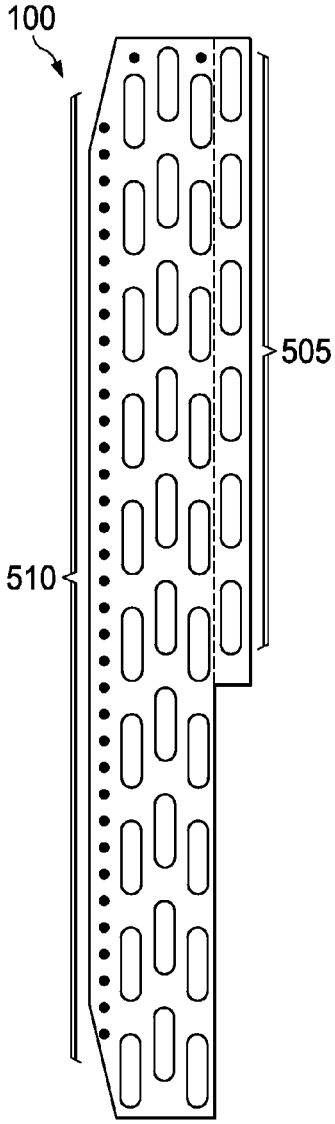
FIGS. 5A and 5B illustrate end views of the heat exchanger of FIG. 4A have return bends coupled to the end of the hairpins.
Figure 5B:
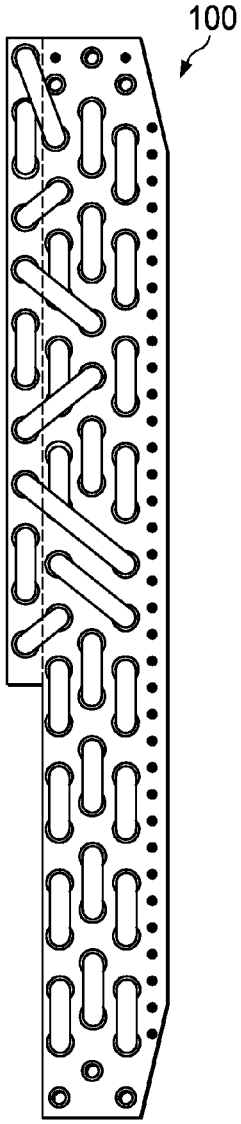

FIGS. 5A-5B illustrate another embodiment of the heat exchanger 100. In this embodiment, finless hairpins 505 are not added to all rows of finned hairpins 510, but only to a portion of the rows of finned hairpins 510. This, again, is for illustrative purposes to show that the number of finless hairpins can vary. For example, in FIG. 5A, ten rows of finned hairpins 510 having at least three hairpins per row are shown, however, only 6 rows of finless hairpins 505 are present and the remaining 4 rows comprise only finned hairpins 510. Again, it should be understood that this configuration may vary with design, as well as the dimensions that are shown for exemplary purposes only. FIG. 5B, merely illustrates the opposite end the heat exchanger 100.

Figure 6:
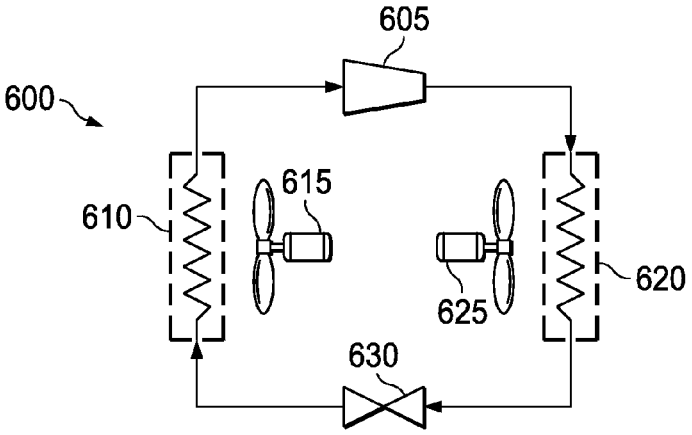
FIG. 6 illustrates a schematic drawing of one embodiment of a HVAC system in which the heat exchanger may be employed.

FIG. 6 is a schematic diagram of one embodiment of a heating ventilation air conditioning system 600 in which the embodiments of the heat exchanger as discussed above may be employed. This embodiment comprises a compressor 605, an evaporator 610 that is fluidly connected to the compressor 605 and which has a fan 615 associated therewith. A condenser 620 is also fluidly connected to the compressor and also has a fan 625 associated therewith and an expansion device 630. The system 600 may include other conventional components typically found in such systems. For example, the compressor 605 and the expansion device 630 may be conventional components. However, at least one of the evaporator 610 or condenser 620 is one of the embodiments of the heat exchanger that includes one or more finless hairpins, as discussed above. Either one or both of the evaporator 610 and condenser 620 may be one of the embodiments of the heat exchanger presented herein. For example, for heat pump application, the evaporator 610 could be working as a condenser, and the condenser 620 could be working as a evaporator.

With reference to FIGS. 1-5B, a method is also provided for manufacturing the heat exchanger discussed above. One embodiment of the method includes providing a header frame having end plates, providing a plurality of hairpins, and providing cooling fins have openings located therethrough. As used herein and in the claims, "providing" means that the recited component may be provided by the manufacturer or obtained by the manufacturer from an outside (e.g. subsidiary) or third party source. Each of the hairpins is placed through each of the openings in the cooling fins. The hairpins and then expanded such that each expands against the circumference of the openings to form a plurality of rows of finned hairpins. The opposing ends of the finned hairpins are placed through a portion of the openings in opposing end plates of the header frame, and opposing ends of the finless hairpins are placed through a remaining portion of the openings in opposing end plates of the header frame.

In one embodiment, the row of the plurality of finned hairpins includes one of the finless hairpins, and in another embodiment, only a portion of the plurality of the rows of finned hairpins includes a finless hairpin. Both finned and finless hairpins may be comprised of aluminum, which includes alloys thereof, or they may both be comprised of copper, which also includes alloys thereof. Alternatively, the finned hairpins may be comprised of copper, while the finless hairpins may be comprised of aluminum, or vice versa.

Those skilled in the art to which this application relates will appreciate that other and further additions, deletions, substitutions and modifications may be made to the described embodiments.

What is claimed is:

1. A method of manufacturing a heat exchanger, comprising:

providing a header frame having end plates;

providing a plurality of hairpins;

providing cooling fins having openings located therethrough;

placing a portion of said plurality of hairpins through each of said openings;

expanding each of said portion such that each expands against a circumference of said openings to form a plurality of rows of finned hairpins;

placing opposing ends of said finned hairpins through a portion of openings in opposing end plates of said end plates;

placing opposing ends of at least one finless hairpin through a remaining portion of said openings in opposing end plates; and coupling a support sheet to said header frame, said at least one finless hairpin extending through said support sheet and being supported thereby.

2. The method recited in claim 1, wherein said row of said plurality of finned hairpins includes one of said finless hairpins.

3. The method recited in claim 1, wherein only a portion of said plurality of rows of finned hairpins includes a finless hairpin.

4. The method recited in claim 1, wherein said finned hairpins and said at least one finless hairpin are comprised of aluminum.

5. The method recited in claim 1, wherein at least one of said finned hairpins and said at least one finless hairpin are comprised of copper.

6. The method recited in claim 1, wherein each row of said plurality of finned hairpins includes a finless hairpin.

7. The method recited in claim 1, wherein a thickness of said cooling fin is about 0.11 mm and a thickness of said support sheet ranges from about 0.5 mm to about 1.27 mm.

8. The method recited in claim 1, wherein said finned hairpins are comprised of copper and said at least one finless hairpin is comprised of aluminum.

* * * * *